US012729038B2

(12) United States Patent
Anderlini et al.

(10) Patent No.: US 12,729,038 B2
(45) Date of Patent: Sep. 8, 2026

(54) CONTAINER FOR FOODSTUFFS AND MANUFACTURING METHOD

(71) Applicant: BIOPAP S.R.L., Milan (IT)

(72) Inventors: Michelangelo Anderlini, Milan (IT); Giuseppe Anghileri, Milan (IT)

(73) Assignee: BIOPAP S.R.L., Milan (IT)

( * ) Notice: Subject to any disclaimer, the term of this patent is extended or adjusted under 35 U.S.C. 154(b) by 0 days.

(21) Appl. No.: 18/651,394

(22) Filed: Apr. 30, 2024

(65) Prior Publication Data

US 2024/0367848 A1 Nov. 7, 2024

(30) Foreign Application Priority Data

May 2, 2023 (IT) ..... 102023000008604

(51) Int. Cl.
*B65D 5/44* (2006.01)
*B65D 1/34* (2006.01)
*B65D 1/46* (2006.01)

(52) U.S. Cl.
CPC ..... *B65D 5/445* (2013.01); *B65D 1/34* (2013.01); *B65D 1/46* (2013.01)

(58) Field of Classification Search
CPC . B65D 5/445; B65D 1/34; B65D 1/46; B65D 5/2057; B65D 2577/2025; B65D 5/0015; B65D 5/20; B65D 5/246; B65D 5/231; B65D 5/4266
USPC ..... 229/186, 125.35
See application file for complete search history.

(56) References Cited

U.S. PATENT DOCUMENTS

| | | | | |
|---|---|---|---|---|
| 2006/0213962 | A1 | 9/2006 | Anghileri | |
| 2023/0050629 | A1 | 2/2023 | Herrero Perez Rioja | |
| 2024/0208692 | A1* | 6/2024 | Wong | B65D 21/0234 |
| 2024/0217696 | A1* | 7/2024 | Herrero Perez Rioja | B65D 5/563 |

FOREIGN PATENT DOCUMENTS

| | | | |
|---|---|---|---|
| EP | 2338800 | A1 | 6/2011 |
| WO | 2002060768 | A1 | 8/2002 |

OTHER PUBLICATIONS

Italian Search Report and Written Opinion dated Feb. 5, 2024, issued in Italian Application No. 2023000008604 (pp. 6).

* cited by examiner

*Primary Examiner* — Christopher R Demeree
(74) *Attorney, Agent, or Firm* — Nixon Peabody LLP

(57) ABSTRACT

A container for foodstuffs and a method for manufacturing a container for foodstuffs having a box body made of a material based on paper; the box body being substantially a cup-shaped body formed by a base and a lateral wall; the lateral wall having a rim which delimits an access opening to said housing; the container having a symmetrical reinforcing rim with respect to a geometric centre and which has been cut from paper-based material in a sheet and has been fixed to the rim of the box body; the reinforcing rim being composed of a plurality of reinforcements joined at their respective ends and, in twos, mirror each other with respect to said geometric centre.

13 Claims, 7 Drawing Sheets

CONTAINER FOR FOODSTUFFS AND MANUFACTURING METHOD

CROSS-REFERENCE TO RELATED APPLICATIONS

This patent application claims priority from Italian patent application no. 102023000008604 filed on May 2, 2023, the entire disclosure of which is incorporated herein by reference.

TECHNICAL FIELD

This patent application relates to a container for foodstuffs, in particular made of a material based on paper, and its manufacturing method.

PRIOR ART

Containers for foodstuffs made of a material based on paper and used for packaging, for example, food preparations, ready meals, meat, vegetables, frozen or fresh foods and the like are known. Containers for foodstuffs made of a material based on paper are advantageously made in large part with renewable raw materials and, through the application of appropriate protective barriers, can resist: grease, oil, moisture; low temperatures without becoming brittle; and high temperatures without becoming soft or burning. Containers made of a material based on paper can thus be used: in ovens, freezers, refrigerators, microwaves, etc.

Containers made of thermoformed cardboard are known, which have a moderate rigidity along the rim and, consequently, deform under the application of internal and external forces. As a result, disadvantageously, containers made of thermoformed cardboard can be more difficult to use with closure systems involving the application of forces on the rim, such as shrink wrapping or stretch film packaging. In fact, containers made of thermoformed cardboard have too little rigidity along the rims for known closure systems that require the application of, for example, a shrink film or a high-tension wrapping film.

Containers for foodstuffs made of cardboard with reinforced also known, which, however, have disadvantages such as a partial and localized reinforcement of the rim with the creation of points of discontinuity, i.e. of weakness, in the container or, in the case of continuous frame reinforcements, have the disadvantage of producing a high waste of material. In addition, the methods for manufacturing cardboard containers for foodstuffs with reinforced rims produce a high amount of production scrap and, thus, produce a waste of raw material and high production and disposal costs.

DESCRIPTION OF THE INVENTION

An object of the present invention is to provide a reinforced container for foodstuffs made of a material based on paper of an improved type. In particular, an object of the present invention is to provide a container for foodstuffs made of cardboard which produces a reduced amount of waste material at the time of manufacture.

An object of the present invention is to provide a method for manufacturing a container for foodstuffs made of a material based on paper of an improved type.

According to the present invention, a container for foodstuffs is provided as set forth in the appended claims.

According to the present invention, a method for manufacturing a container for foodstuffs is provided as set forth in the appended claims.

BRIEF DESCRIPTION OF THE DRAWINGS

The invention will now be described with reference to the accompanying drawings, which illustrate a non-limiting embodiment of the invention, wherein.

PREFERRED EMBODIMENT OF THE INVENTION

Figure 1:
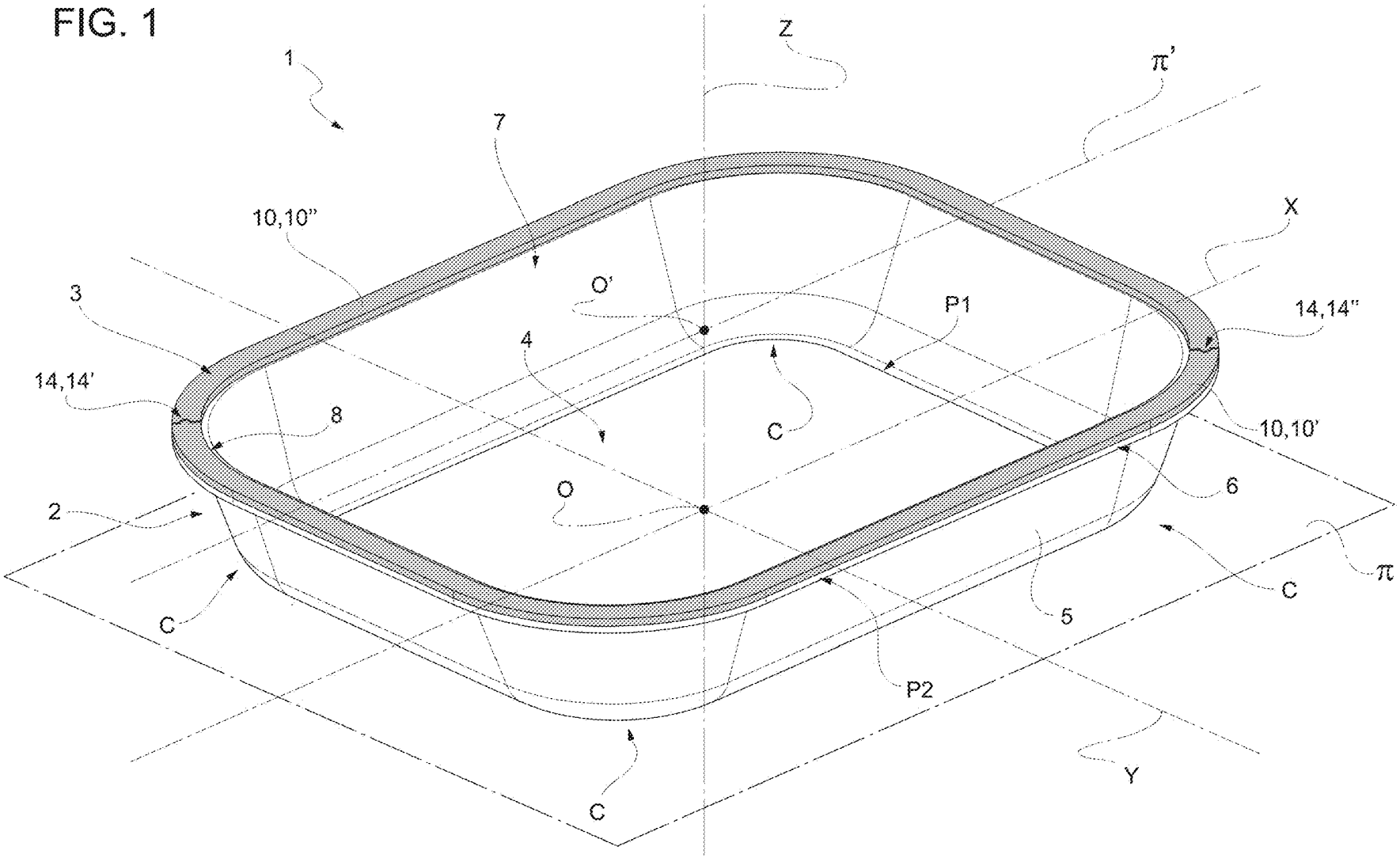
FIG. 1 illustrates a container for foodstuffs according to the present invention.

In FIG. 1, the reference number 1 indicates, as a whole, a container for foodstuffs, in particular a container made of a material based on paper. The container 1 comprises a containing body, defined hereinafter generically as box body 2, which is configured to house objects and, in particular, is of a cup or tray type. In particular, the box body 2 has a rim 6, on which a reinforced rim 3 is applied, as will be better illustrated in the following.

The container 1 illustrated in FIG. 1 is only an example and is not limitative; according to variants not illustrated, the container 1 can have different shapes and sizes.

The box body 2 and the reinforcing rim 3 can be made of the same or different materials. Advantageously, the box body 2 and the reinforcing rim 3 are made of a material which resists both high and low temperatures. For example, the box body 2 and the reinforcing rim 3 are made of a material that is resistant in the following temperature ranges: from −80° C. to +215° C.; from −35° C. to +175° C.; from +3° C. to +145° C. Therefore, the box body 2 and the reinforcing rim 3 can be heated in an oven (conventional or microwave) or stored in a refrigerator or freezer. In particular, as will be better illustrated in the following, the box body 2 and the reinforcing rim 3 are obtained from material 40 based on paper (FIG. 6), in sheet or reel form.

According to the illustrated example, the box body 2 consists of a base 4 and a lateral wall 5. The base 4 is essentially a flat body with an axis of symmetry X.

Hereinafter, a vertical axis Z and a transverse axis Y with the origin in the geometric centre O of the base 4, together with the axis of symmetry X, are taken as XYZ reference system.

Hereinafter, terms such as top, bottom, front, rear, right, left, and the like are used with reference to the normal use of the container 1 resting, according to normal use, on a resting plane. One can see in the illustrated example that the base 4 is quadrangular in shape, in particular square or rectangular, and the transverse axis Y is also an axis of symmetry.

The base 4 has a perimeter p1 that is rectangular in shape with rounded corners C. The lateral wall 5 is connected, in a known and schematically illustrated manner, to the perimeter p1 of the base 4 and protrudes, along the entire perimeter p, from the base 4 along the vertical axis Z. Preferably, the lateral wall 5 is flared, in other words inclined with respect to the vertical axis Z, towards the outside of the box body 2.

The lateral wall 5 has a rim 6, which extends along the entire upper end of the lateral wall 5.

The lateral wall 5 and the base 4 form a housing 7, which faces the outside through an opening 8 delimited by the rim 6 of the lateral wall 5. According to the illustrated example, the rim 6 has a shape similar to that of the base 4; according to a variant not illustrated, the rim 6 and the base 4 can have different shapes.

Hereinafter, inner surface s1 is understood to be the surface of the box body 2 facing the housing 7, and outer surface s2 is understood to be the surface of the box body 2 facing outwards.

Figure 7C:
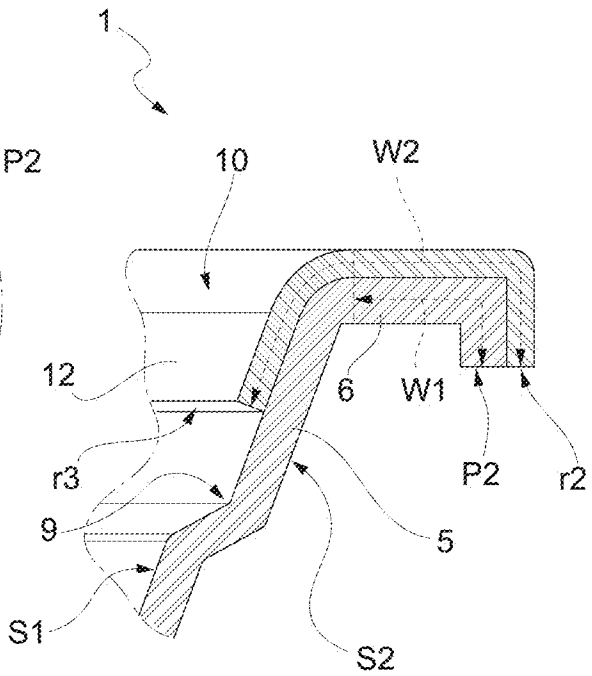
FIGS. 7*a*, 7*b*, 7*c* illustrate respective different variants of a detail of the container according to the present invention.

According to the example illustrated in FIG. 7*c*, the box body 2 has a recess 9, which is interposed between the lateral wall 5 and the rim 6 to facilitate the unstacking of the containers 1. The recess 9 is basically a bend in the lateral wall 5 which extends around the entire perimeter and has an outward concavity. The depth (extension along the vertical axis Z) and the length of the recess 9 are variable. The rim 6 protrudes above the recess 9. The rim 6 is inclined with respect to the vertical axis Z towards the outside of the box body 2, so as to substantially have an annular profile (FIG. 1).

Advantageously, the rim 6 has a central symmetry with respect to a geometric centre O' located on a plane π', which is substantially parallel to the support plane π and coplanar to said rim 6. In particular, the rim 6 has, in turn, a shape similar to that of the base 4. The rim 6 is quadrangular in shape, in particular square or rectangular. According to the illustrated example, the geometric centres O and O' are aligned along the vertical axis Z. Advantageously, the rim 6 has, in a plan view, an external perimeter p2 and an internal perimeter p3 parallel and concentric to each other. The width w1 (the distance between the external perimeter p2 and the internal perimeter p3) of the rim 6 is variable.

Figure 2:
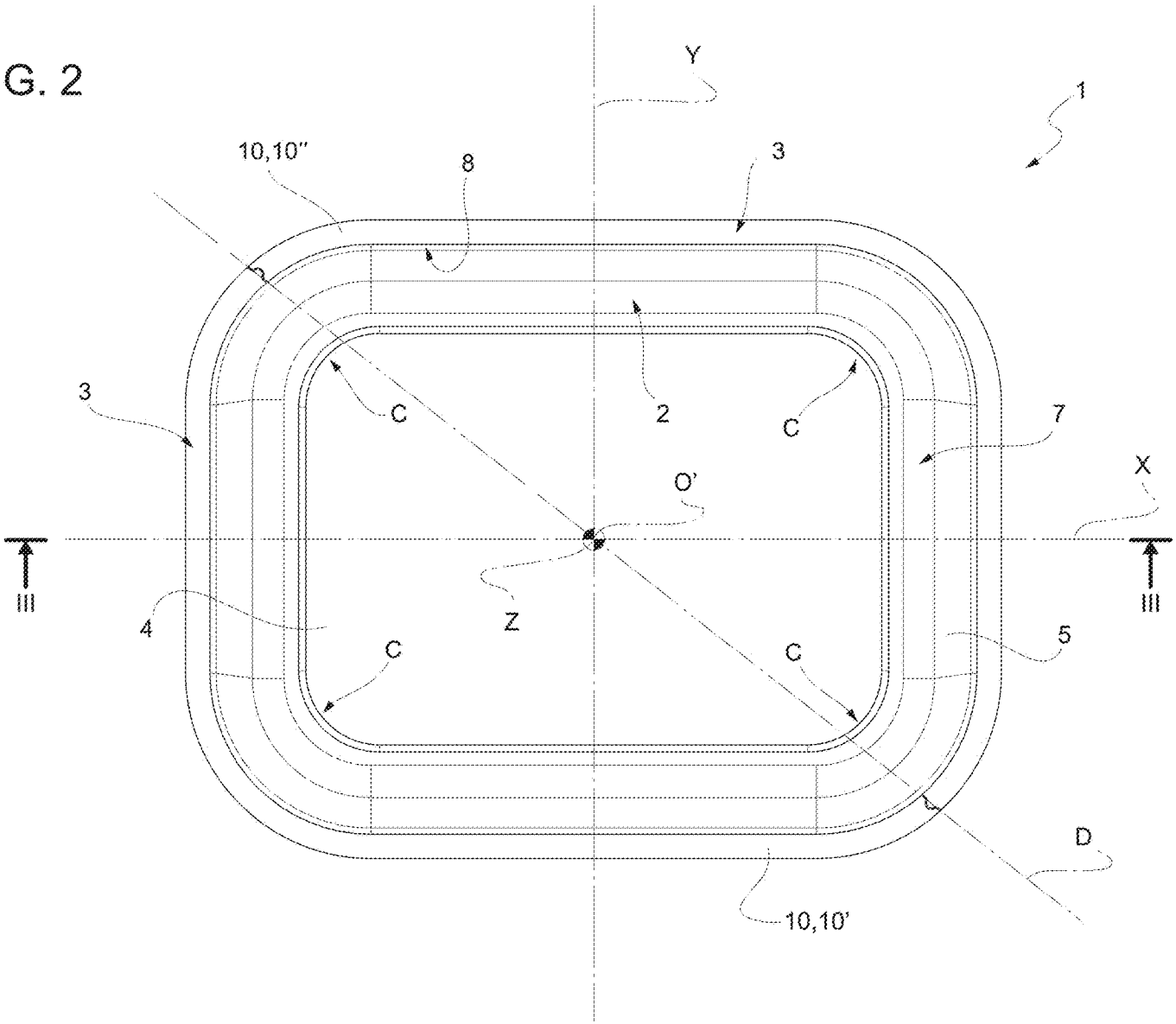
FIG. 2 is a plan view of the container of FIG. 1.

As a result of the central symmetry, i.e. the symmetry with respect to a geometric centre O' that lies within the opening 8, advantageously, the rim 6 of the box body 2 can be divided by a diagonal D (a single diagonal D is illustrated in FIGS. 1 and 2 for the sake of clarity) into two portions 60, hereinafter identified by 60' and 60", which are substantially equal to and opposite each other.

Without losing generality, the number and shape of the portions 60 can vary depending on the number and inclination of the diagonals D used to subdivide the rim 6. In case of two subdividing diagonals D there will be four portions 60, and so on. Preferably, the number of portions 60 is reduced to two, as in the illustrated case, in order to reduce the points of contact to a bare minimum at the moment of assembly of the reinforcing rim 3. For geometries of the box body 2 different from those illustrated, the preferred minimum number of portions 60 can be greater than two.

Since the box body 2 was produced by thermoforming (in a known manner) a material 40 based on paper, in sheet or reel form, i.e. a flat material, there are creases (of a known type and not illustrated) at the rounded corners C of the box body 2, which creases form naturally and in a known manner during the thermoforming of the flat material for the production of a three-dimensional body.

The reinforcing rim 3 is fixed to the rim 6, as will be better explained in the following. Advantageously, the reinforcing rim 3 covers the entire rim 6 of the container 1. Advantageously, there are no areas of discontinuity along the reinforcing rim 3; in other words, there are no areas of the rim 6 without the reinforcing rim 3, i.e. there are no free areas of the rim 6.

Advantageously, the reinforcing rim 3 comprises, in turn, a plurality of reinforcements 10. Preferably, the reinforcements 10 can be combined with one another so as to make up, in use, the reinforcing rim 3 in its entirety. According to the example illustrated in the figures, there are two reinforcements 10, identified hereinafter by 10' and 10", which have substantially the same shape and the same dimensions. The reinforcements 10' and 10" are combined to form a reinforcing rim 3 that can be at least partially laid on the rim 6 of the box body 2.

Figures 3, 4:
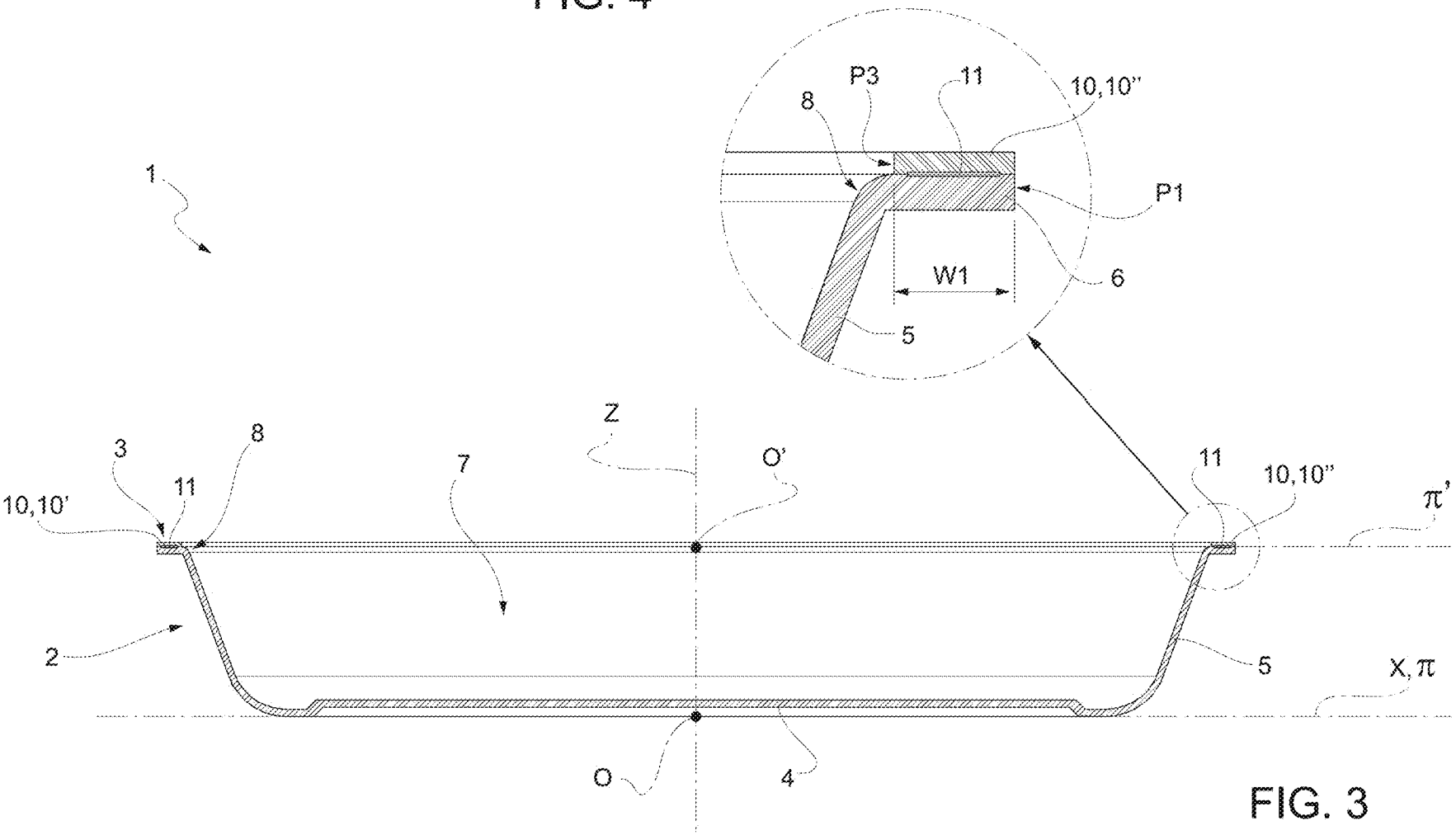
FIG. 3 is a longitudinal section of the container of FIG. 1.
FIG. 4 illustrates a detail of FIG. 3.

Advantageously, the container 1 comprises, for each reinforcement 10, one or more fixing elements 11 (schematized in FIGS. 3 and 4). Each fixing element 11 is, for example, a layer of adhesive material, which fixes the respective reinforcement 10 to the rim 6 of the box body 2. Each fixing element 11 is configured to resist in all possible operating conditions to which a container for foodstuffs is normally subjected. In particular, each fixing element 11 is configured to resist the following temperature ranges: from −80° C. to +215°; from −35° C. to +175° C.; from +3° C. to +145° C. Thus, advantageously, the container 1 can be heated in conventional and microwave ovens and be stored in deep freeze or in refrigerated environments for long periods. For example, each fixing element 11 is a layer of adhesive or heat-sealing material. Each fixing element 11 can be applied, prior to assembly, at the respective areas of contact on the box body 3 or on the reinforcement 10 or on both.

Figure 6:
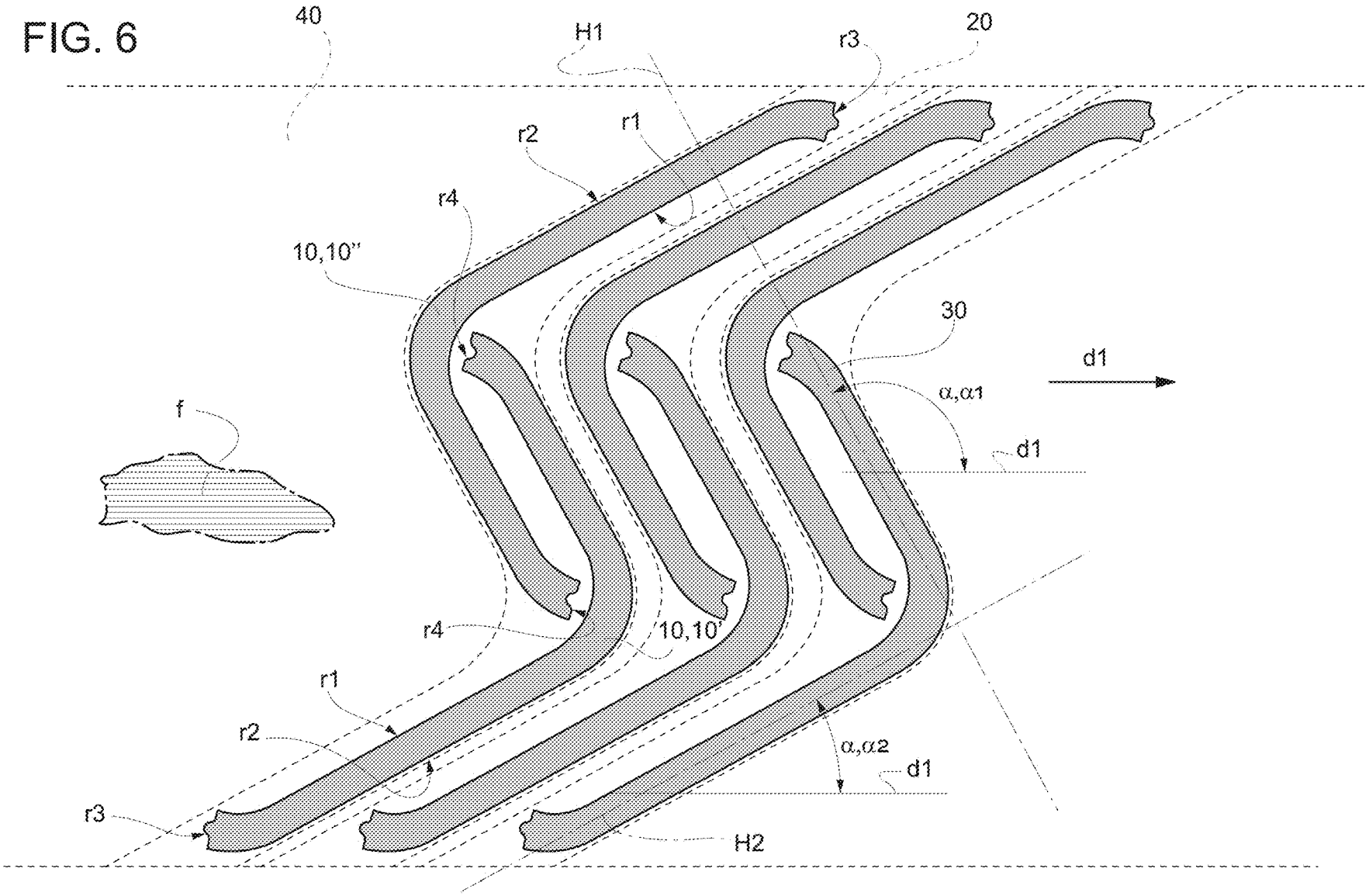
FIG. 6 schematically illustrates a further step of the method for manufacturing a container according to the present invention.

Each reinforcement 10 has been cut with a cutting-die module 20, schematized as a dashed line in FIG. 6, from the material 40 based on paper. The cutting-die module 20 replicates, in shape, substantially the geometry of the portion 60 of the rim 6 on which it is to be applied, as will be better illustrated in the following. In particular, reinforcement 10 is delimited by two longer and each substantially parallel sides, hereinafter identified by r1 and r2, and two transverse sides r3 and r4.

The reinforcements 10 can be produced in different ways. According to a variant not illustrated, the transverse sides r3 and r4 of each reinforcement 10' and 10" are substantially straight and parallel to the ideal diagonal D of the rim 6.

According to a further variant not illustrated, the transverse sides r3 and r4 of each reinforcement 10' and 10" are substantially straight and are inclined with respect to the ideal diagonal D of the rim 6. In this manner, when the reinforcements 10' and 10" are joined at their respective corners, a junction line is formed which does not lie on the axis of the ideal diagonal D.

According to the example illustrated in the figures, the transverse sides r3 and r4 of each reinforcement 10 (10'; 10") are cut along complementary templates, so that they can fit together, and potentially dovetail, along a junction line 14 with a variable profile. In particular, the junction line 14 has a curve conveniently designed to obtain a dovetail and to centre two adjacent reinforcements 10' and 10" with respect to each other. In the illustrated example, there are two reinforcements 10 which fit together along two hinge lines 14, hereinafter identified by 14' and 14", at the respective transverse sides r3 and r4. Preferably, in order to avoid introducing an element of weakness in the container 1, the junction line 14 does not run linearly along a radius of the corner C of the box body 2. Preferably, the junction line 14 runs, at least partially, along a direction with an inclination different from the radius of the relevant corner C. Advantageously, the junction line 14 runs along an at least partially curved path as in the illustrated example.

Preferably, but not limitatively, each reinforcement 10 (10'; 10") has a width w2 (i.e. the distance between the respective longer sides r1 and r2) equal to or greater than the width w1 of the rim 6.

If the width of a reinforcement 10 (10', 10") is equal to the width of the rim 6, this creates a reinforcing rim 3 perfectly laid on top of the rim 6 of the box body 2 (FIGS. 1 to 3).

If the width of a reinforcement (10', 10") is greater than the width w1 of the rim 6, a flap 12 is obtained. The flap 12 can project from the external perimeter p2, from the internal perimeter p3, or from the external perimeter p2 and from the internal perimeter p3. In other words, the flap 12 can protrude to the outside and/or the inside of the box body 2.

Possible variants of a container 1 with at least one flap 12 (FIGS. 7*a* to 7*c*) are described in the following, by way of example and not limitatively.

Figure 7B:
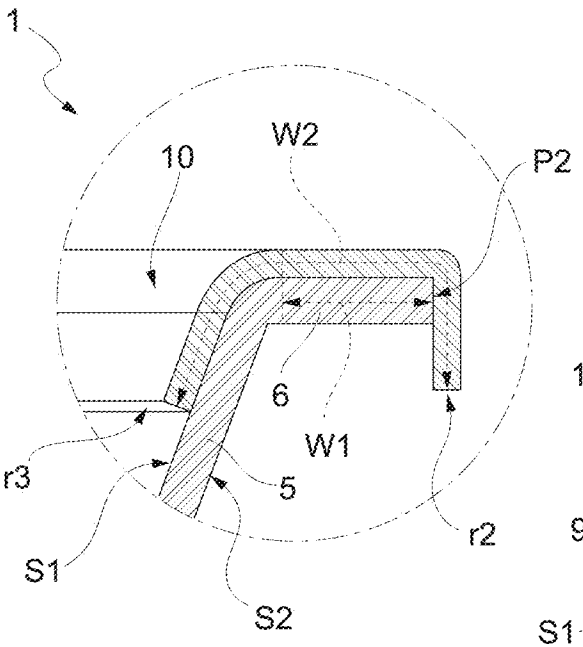
Figure 7A:
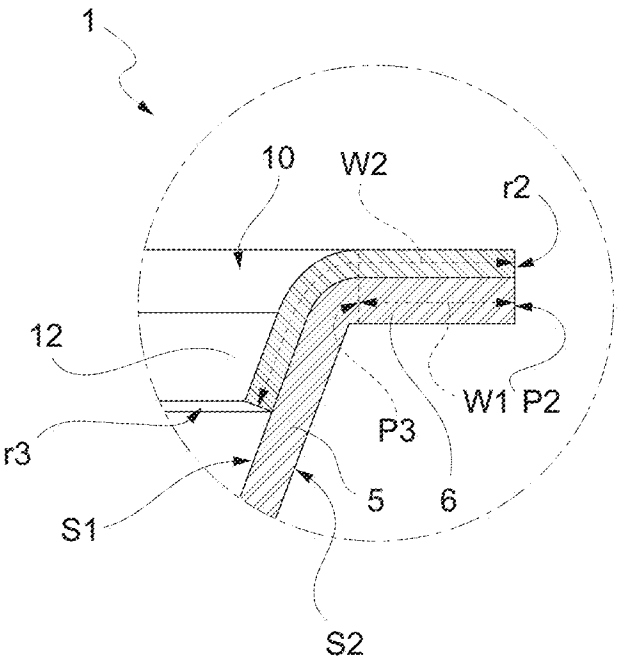

FIG. 7*a* illustrates an example where the flap 12 is folded, substantially forming an "L" facing the inside of the box body 2. The flap 12 is pressed against and made to adhere, for example through the use of glues or heat seals, to the internal surface s1.

FIG. 7*b* illustrates an example where the flap 12 protrudes from the external perimeter p2 of the rim 6. In this case, advantageously, the flap 12 is folded in a "U"-shape with respect to the rim 6 and forms a continuous surface with no edges, which facilitates certain operations for closing said box body 2 such as: binding, wrapping, flow wrapping, shrink-wrapping with thin films, which do not risk being abraded or cut during the handling of the containers 1.

FIG. 7*c* illustrates an example where the reinforcing rim 3 and the rim 6 are substantially folded in an "L"-shape of towards the base 4 along the external perimeter p2. In this case, advantageously, in order to further reduce the consumption of raw material, the reinforcement 10', 10" and the rim 6 are together folded downwards, by a section of their width, which results in a superimposed, U-shaped double structure, which has the highest mechanical robustness.

In the examples illustrated in FIGS. 7*b* and 7*c*, the reinforcing rim 3 is folded in a "U"-shape with the concavity facing the base 4. This type of reinforcing rim 3 has a higher rigidity than the L-shaped variants.

Advantageously, the flap 12 has a thickness less than or equal to the depth of a potential recess 9 so as not to constitute a step within the housing 7 and, consequently, its thickness will not be exposed, in use, directly to any sauces or liquids present in the foodstuffs placed in the housing 7.

The flaps 12 can be obtained along the entire external perimeter p2 and/or internal perimeter p3 of the rim 6 or only along certain sections.

According to a variant not illustrated, the reinforcing rim 3 is formed by four or more reinforcements 10. According to a further variant not illustrated, the rim 6 can have a polygonal shape with more than four sides; in this case, the number of reinforcements 10 can be greater than four. The reinforcements 10 of a same reinforcing rim 3 can differ from one another, for example in shape and/or size and/or material.

Advantageously, the box body 2 and the reinforcements 10 can be made using different materials. In particular, the box body 2 and the reinforcements 10 can be made using materials with different thicknesses and/or basis weights. It is noted that the reinforcements 10 of a same container 1 can be made using different materials. It is thus possible to combine the materials of the box body 2 and of each reinforcement 10 so as to obtain the desired local stiffness while minimizing the use of raw material.

Advantageously, the reinforcements 10 are made of printable material. This makes it possible to reproduce text and images with an informative or identifying function (display of a logo and/or name of the manufacturer) as well as a decorative function on the reinforcements 10.

Advantageously, the material of the box body 2 and of each reinforcement 10 is treated; for example, it is painted, lacquered, laminated, extruded with appropriate layers designed to make it resistant to machines, moisture and grease and to make it heat-sealable.

Advantageously, the raw materials constituting the box body 2 and each reinforcement 10 derive entirely or in a high percentage from renewable sources. Non-renewable components are also conceivable, such as for adhesives, coatings, laminations, extrusions, as long as they are not significant and preferably do not exceed 20% or preferably 5% by mass of the reinforced container 1.

The preferable disposal for the container 1 according to the present invention is composting, which is why advantageously the material for producing the box body 2, the reinforcing rim 3, the fixing elements 11 and any inks and lacquers should preferably be biodegradable and compostable according to the standard EN 13432 both in industrial composting and in domestic composting. As an alternative to organic recycling in the form of composting, it is also preferable for the container 1 according to the present invention to be recyclable into paper according to the criteria of the Aticelca® system and preferably in Class A+, A or B. In this case, the reinforcements 10 and the box body 2 can also not be biodegradable and compostable.

Based on what has been set forth above, with a container 1 comprising a box body 2 that is rectangular in shape with an average radius of the corners C of 30 mm, the material savings for obtaining the reinforcing rim 3 according to the present invention is 70% compared to reinforcements of a known type.

A manufacturing method according to the present invention is described hereinafter. It should be noted that the sequence of the steps of the method described hereinafter is purely for expository purposes. In other words, the steps of the method described hereinafter can be carried out simultaneously, i.e. in parallel, or in a different order. Moreover, the method for manufacturing a single container is described. These steps can be repeated mutatis mutandis for the production of batches of containers 1.

The method comprises the step of providing a plurality of reinforcements 10 to a station for feeding an assembly line. The step of providing the reinforcements 10 can comprise the sub-step of cutting the reinforcements 10 from a sheet or strip of material 40 based on paper. For example, the sub-step of cutting the reinforcements 10 can be implemented by die cutting, in particular flatbed die cutting, from sheets. Some examples of known die cutters are platinum die cutters or high-speed horizontal die cutters. Preferably, the use of die cutters allows obtaining a high number of reinforcements 10 for each stroke of the die cutter. According to a preferred embodiment, the die cutter is fed by means of a reel.

According to the example illustrated, the cutting-die module 20 is substantially S-shaped and two reinforcements 10, which lie side by side, are cut inside the same. In the example, the reinforcements 10 are L-shaped and their respective short sides are parallel to each other, substantially in contact (in other words, the distance between the short sides of the adjacent reinforcements is minimized). In particular, the cutting-die module 20 for cutting a reinforcement 10 described in the foregoing is of a reduced width; in particular, the width of the cutting-die module 20 is slightly greater than the diagonal of the box body 2. Therefore, advantageously, the cutting-die module 20 (illustrated in dashed lines in FIG. 6), which reproduces the minimum multiple of the reinforcements 10 required to complete the reinforcing rim 3 of a box body 2, is of reduced dimensions. For example, a cutting die can comprise multiple cutting-die modules 20 that operate across almost the entire width of the material 40 based on paper feeding the die cutter. Advantageously, this solution makes it possible to minimize production waste during the sub-step of cutting the reinforcements 10 and to employ lightweight, not very complex equipment.

The step of providing the reinforcements 10 can be implemented in line with a subsequent assembly line or can be implemented by feeding stacks of reinforcements 10 from a warehouse. In this case, the sub-step of providing the reinforcements 10 comprises the sub-step of packing the reinforcements 10 for transport, and the steps of cutting the reinforcements 10 and the subsequent assembly line can also be run in separate factories.

The manufacturing method further comprises providing a box body 2.

The step of providing a box body 2 comprises, for example, the sub-step of producing, in a known manner, a box body 2 from a material based on paper, in a sheet form, by thermoforming or equivalent methods.

Figure 5:
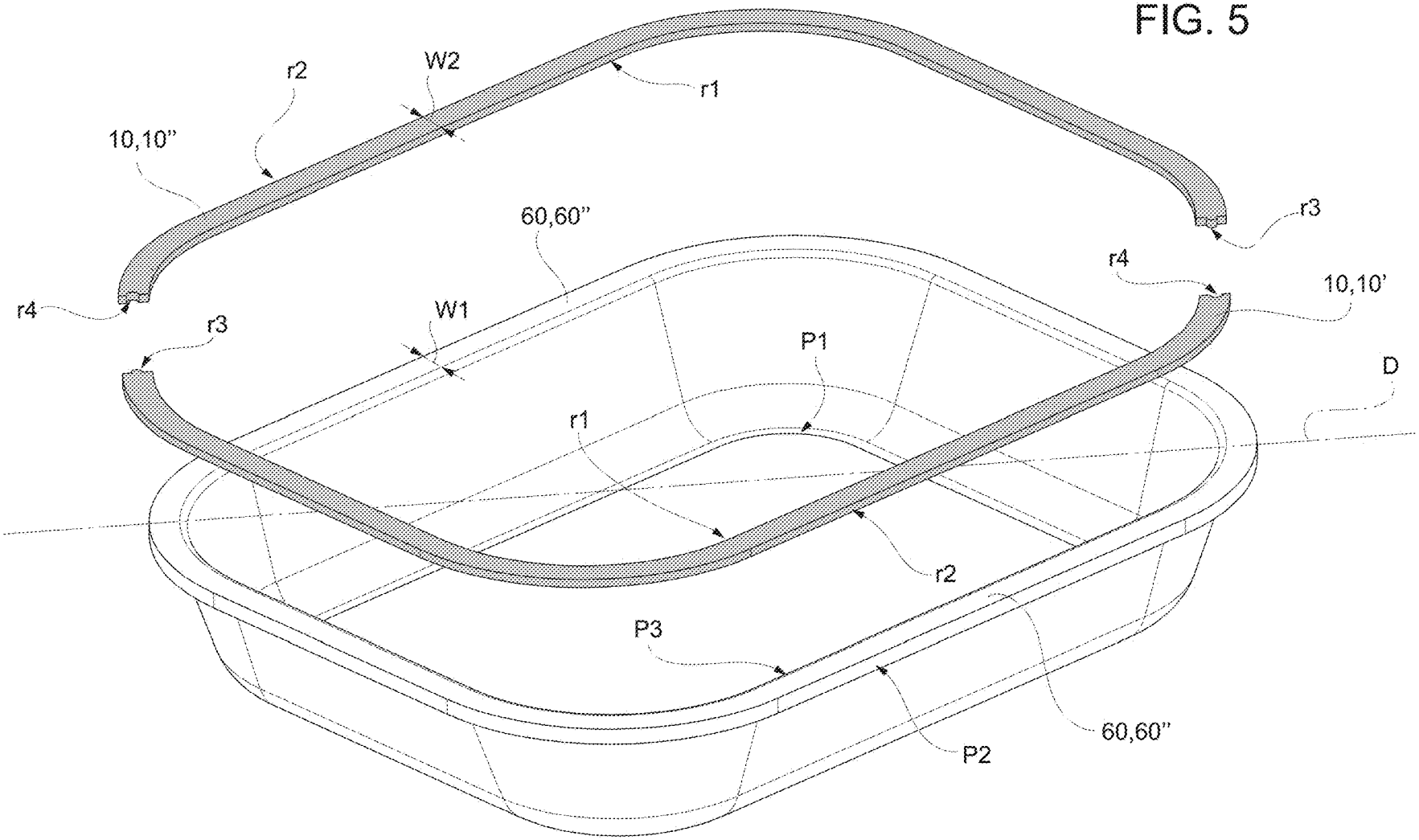
FIG. 5 schematically illustrates a step of the method for manufacturing the container according to the present invention.

The method further comprises the step of assembling a plurality of reinforcements 10 with a respective box body 2. In particular, the step of assembling comprises the sub-step of picking up from one or more feed stations the number of reinforcements 10 required to complete the reinforcing rim 3 of the box body 2. The sub-step of picking up comprises handling a predetermined number of reinforcements 10 using suction-cup translators. In particular, the suction-cup translators rototranslate the reinforcements 10 in order to position and orient said reinforcements 10 in relation to one another in order to form the reinforcing rim 3 (FIG. 5). The step of assembling can comprise the sub-step of translating and rotating one reinforcement 10' in relation to the other reinforcement 10". In particular, the step of assembling involves placing each reinforcement 10', 10" on a respective portion of the rim 6 of the box body 2 so that their ends are in contact with one another in order to form a closed perimeter, in particular a perimeter of a polygonal shape. According to the illustrated example, the transverse side r3 of a reinforcement 10', 10" is placed adjacent to, or in contact with, the transverse side r4 of the other reinforcement 10', 10'.

The phase of assembling can comprise the sub-step of dovetailing the ends 4 two adjacent reinforcements together.

Advantageously, the step of assembling is implemented so as to juxtapose the reinforcements 10 on the rim 6 of the box body 2.

Advantageously, the fact that the reinforcements 10 are obtained by a substantially S-shaped cutting-die module 20 allows the reinforcements 10 to be cut at a different angle of the fibres forming the material 40 based on paper in sheet form with respect to the direction of the fibres forming the box body 2. In other words, the fact that it is possible to select the inclination x with which at least a portion of the S of the cutting-die module 20 is cut with respect to the direction dl of the fibres constituting the material 40 based on paper allows predetermining and selecting the orientation of the fibres forming the material based on paper of the reinforcements 10 with respect to the orientation of the fibres forming the material 40 based on paper of the box body 2. This, advantageously, allows selectively increasing the stiffness of the container 1, in particular at the corner C, by predetermining the relative orientation of the fibres forming the reinforcements 10 with respect to the fibres forming the box body 2. According to the example illustrated in FIG. 6, each reinforcement 10 comprises two sides, hereinafter identified by 30 and 31, which form an "L" with a connected corner. In particular, the side 30 is the short side of the "L" and extends along an axis H1 that is inclined by an angle $\alpha$1 with respect to the direction dl of the fibres f. The side 31 is the long side of the "L" and extends along an axis H2 that is inclined by an angle $\alpha$2 with respect to the direction dl of the t fibres f. According to the illustrated example, the axes H1 and H2 are perpendicular to each other; according to a variant not illustrated, the axes H1 and H2 can have a different reciprocal inclination. The angles $\alpha$1 and $\alpha$2 illustrated are merely illustrative and can vary.

The method further comprises the step of fixing the reinforcements 10 to the rim 6 of the box body 2. For example, the reinforcements 10 are glued or welded by means of fixing elements 11, which are activated through the combined effect of temperature and pressure. For example, the box body 2 and/or reinforcements 10 have heat-sealed contact surfaces. In this case, the fixing element 11 is a heat-sealing layer which can be applied through spreading, painting, extrusion or lamination. As further examples of fixing elements 11, it is possible to use: acrylic or vinyl adhesives; lacquers, coatings, synthetic or natural polymers, biopolymers. The temperature and pressure applied during the step of fixing are a function of the type of fixing element 11 and the method of activation.

The manufacturing method of a container 1 according to the present invention can optionally comprise the further step of folding the reinforcements 10. In particular, if the reinforcements 10 have a width greater than that of the rim 6, the flaps 12, which can protrude to the outside or to the inside of the box body 2, can be folded (for example into a "L"—or "U"-shape). Advantageously, the folding of the reinforcements 10 and, potentially, of the rim 6 allows the reinforced rim 3 to be further strengthened.

The manufacturing method of a container 1 according to the present invention can be performed along a single processing line or on multiple processing lines and can be performed continuously or in stages. The number of stations can vary depending on the required processing speed.

Advantageously, the manufacturing method of a container 1 according to the present invention in which the reinforcing rim 3 comprises a plurality of pieces (reinforcements 10) allows waste material 40 based on paper to be significantly reduced with respect to a conventional method in which the reinforcing rim 3 is made in one piece.

Figure 8:
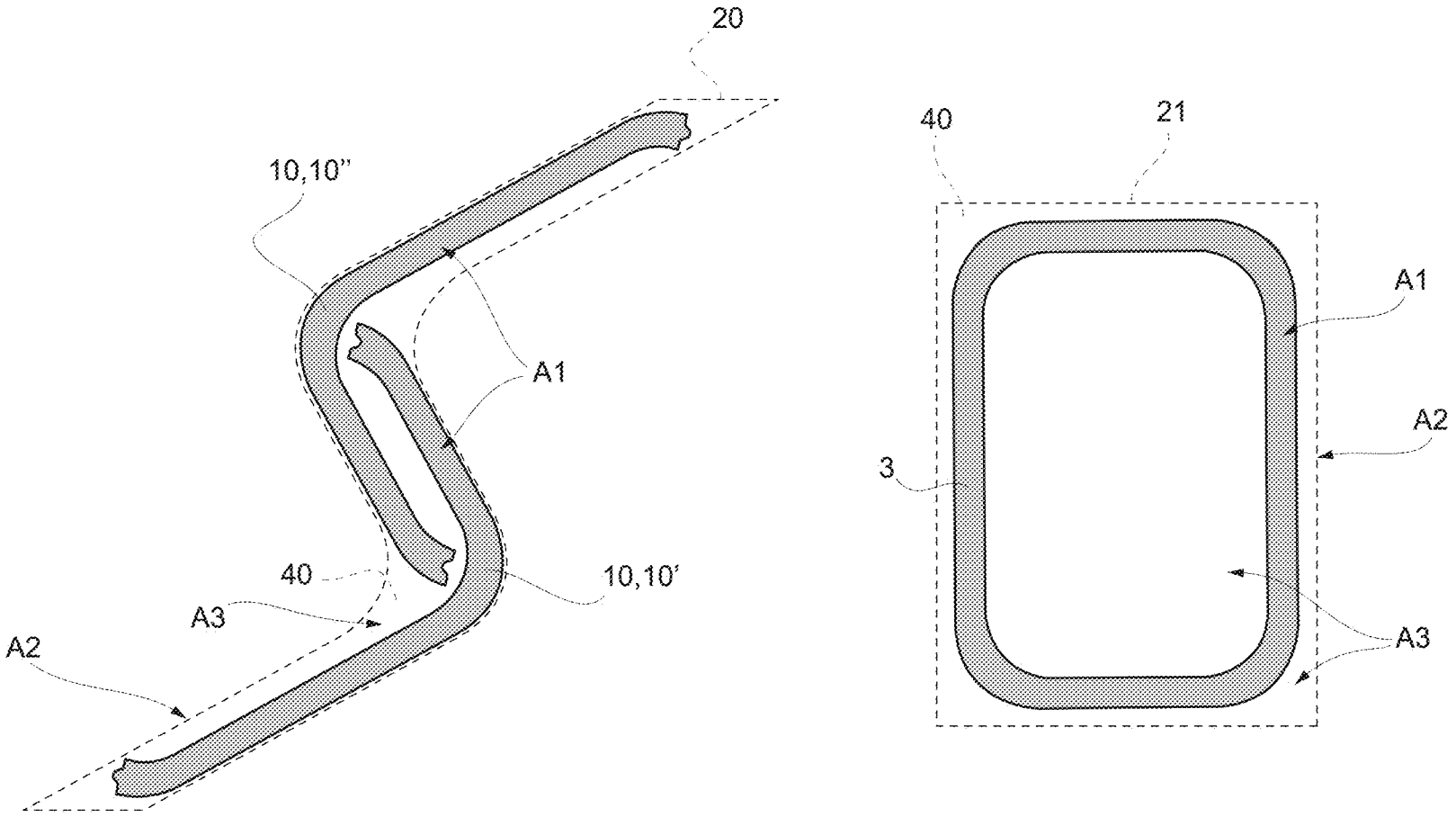
FIG. 8 illustrates a schematic comparison between a detail according to the present invention and the state of the art.

FIG. 8 illustrates a schematic comparison between the use of material 40 based on paper according to the present invention using the cutting-die module 20 (left) as described above and according to a traditional method using a cutting-die module 21 (right) of a traditional type from which the reinforcing rim 3 is obtained in one piece. In particular, for a reinforcing rim 3 with the same final dimensions, it is possible to obtain the values indicated in the following table.

| | Method according to the present invention (reinforcing rim comprising multiple pieces) | Known solution (reinforcing rim in one piece) |
|---|---|---|
| AREA REINFORCING RIM A1 | 9066.84 $mm^2$ | 9066.85 $mm^2$ |
| TOTAL AREA OF MATERIAL USED A2 | 17606.18 $mm^2$ | 37083.75 $mm^2$ |
| AREA OF SCRAP A3 | 8539.34 $mm^2$ | 28016.9 $mm^2$ |

From the numerical comparison illustrated in the preceding table, it can thus be observed that, for a produced reinforcing rim 3 of equal size:

the area of scrap A3 according to the method of the present invention is smaller by percentage (about 94%) than the area A1 of the reinforcing rim 3; while, according to the method of the prior art, the area of scrap A3 is significantly larger (309%) than the area A1 of the reinforcing rim 3;

the area of scrap A3 according to the method of the present invention is about 69.5% less than the area of scrap A3 according to the method of the prior art;

the total area A2 of material 40 based on paper employed according to the method of the present invention is about 47.5% less than the total area A2 of material 40 based on paper employed according to the method of the prior art.

The invention claimed is:

1. A container for foodstuffs comprising a box body made of a material based on paper;

the box body comprising a base having a first perimeter and a lateral wall, which is connected to the first perimeter of the base;

wherein the base and the lateral wall form a cup-shaped body having a housing;

the box body having a first rim, which delimits an access opening to said housing;

the container comprising a second reinforcing rim having a symmetric shape in plan with respect to a geometric centre;

wherein said second rim has been cut from a flat material based on paper and has been fixed to said box body so as to completely cover said first rim;

wherein said second rim comprises a plurality of reinforcements in twos which mirror each other with respect to said geometric centre;

wherein the plurality of reinforcements are two;

wherein each reinforcement has substantially an L shape in plan;

wherein said reinforcements are in contact with each other along a first junction line and a second junction line at two respective opposite corners of said second rim.

2. A container according to claim 1, wherein said second rim comprises two reinforcements, which are:

mirror images of each other;

placed on the same plane, in particular on the plane of said first rim;

rotated 180° relative to each other;

in contact with each other at the respective ends.

3. A container according to claim 1, wherein said second rim has a substantially polygonal shape, in particular rectangular or square, with rounded corners.

4. A container according to claim 1, wherein said first junction line and said second junction line are symmetrical to each other with respect to said geometric centre of said second rim.

5. A container according to claim 4, wherein said first junction line and said second junction line are at least partially curved.

6. A container according to claim 4, wherein said first junction line and said second junction line are straight.

7. A container according to claim 1, wherein the first rim has a first width; each reinforcement having a second width greater than said first width, so that a flap protrudes from the internal perimeter and/or from the external perimeter of said first rim.

8. A manufacturing method of a container for foodstuffs comprising a box body made of a material based on paper; the box body comprising a base having a first perimeter and a lateral wall connected to the perimeter of the base; wherein the base and the lateral wall form a cup-shaped body having a housing; the box body having a first rim which delimits an access opening to said housing; the container comprising a second reinforcing rim cut from a flat material based on paper and having a symmetric shape in plan with respect to a geometric centre, the second rim comprising a plurality of reinforcements in twos which mirror each other with respect to said geometric centre; the method comprising the steps of:

providing a box body;

providing a plurality of reinforcements;

assembling said reinforcements so as to form a closed geometrical shape, which corresponds substantially to said second rim;

fixing said second rim to said first rim of the box body so as to completely cover said first rim;

wherein the step of assembling comprises the sub-step of cutting two L-shaped reinforcements from the flat material based on paper; wherein during the step of cutting, short sides of the reinforcements are parallel and adjacent to each other, substantially in contact, so as to be cut from a cutting-die module with a substantially S-shape; and to perform a rototranslation of 180°, with respect to a support plane, of one of the two reinforcements with respect to an other of the two reinforcements, and wherein after the step of assembling, said reinforcements are in contact with each other along a first junction line and a second junction line at two respective opposite corners of said second rim.

9. A method according to claim 8, wherein the sub-step of cutting comprises orienting at least a portion of the cutting-die module as a function of the direction of orientation of the fibres forming the material based on paper, so that each reinforcement has fibres oriented with a predetermined inclination with respect to a reference axis.

10. A method according to claim 9, wherein the sub-step of assembling comprises laying the second rim and the first rim on top of each other so that the fibres of said second rim are at least partially inclined with respect to the fibres of said first rim.

11. A method according to claim 8, wherein said first rim has, in plan, an external perimeter and an internal perimeter parallel and concentric to each other; the method comprising the step of folding, at least partially, the first rim and/or the second rim.

12. A method according to claim 11, wherein the sub-step of fixing comprises folding along said external perimeter both the first rim and the second rim towards the base.

13. A method according to claim 11, wherein said second rim comprises a flap, which protrudes from said internal perimeter; wherein the sub-step of fixing comprises to fold the flap towards the base and to fix said flap to the lateral wall.

* * * * *